US011739593B2

(12) United States Patent
Purcell

(10) Patent No.: US 11,739,593 B2
(45) Date of Patent: Aug. 29, 2023

(54) DRILL BIT ASSEMBLY FOR PERCUSSION DRILL TOOLS

(71) Applicant: Mincon International Limited, Shannon (IE)

(72) Inventor: Joseph Purcell, Ennis (IE)

(73) Assignee: Mincon International Limited, Shannon (IE)

( * ) Notice: Subject to any disclaimer, the term of this patent is extended or adjusted under 35 U.S.C. 154(b) by 245 days.

(21) Appl. No.: 17/294,135

(22) PCT Filed: Nov. 20, 2019

(86) PCT No.: PCT/EP2019/081934
§ 371 (c)(1),
(2) Date: May 14, 2021

(87) PCT Pub. No.: WO2020/104527
PCT Pub. Date: May 28, 2020

(65) Prior Publication Data

US 2022/0154535 A1 May 19, 2022

(30) Foreign Application Priority Data

Nov. 22, 2018 (IE) ..... 2018/0460
Jun. 20, 2019 (IE) ..... 2019/0096

(51) Int. Cl.
*E21B 10/36* (2006.01)
*E21B 4/14* (2006.01)
*E21B 10/633* (2006.01)

(52) U.S. Cl.
CPC ..... *E21B 10/36* (2013.01); *E21B 4/14* (2013.01); *E21B 10/633* (2013.01)

(58) Field of Classification Search
CPC ..... E21B 10/627; E21B 10/36; E21B 4/14; E21B 10/633
See application file for complete search history.

(56) References Cited

U.S. PATENT DOCUMENTS 4,079,793 A 3/1978 Mosely et al.
4,765,418 A 8/1988 Ennis
(Continued)

FOREIGN PATENT DOCUMENTS

GB 2 132 252 A 7/1984

OTHER PUBLICATIONS

International Search Report and Written Opinion from corresponding International Patent Application No. PCT/EP2019/081934, dated Apr. 21, 2020.

(Continued)

*Primary Examiner* — Yong-Suk (Philip) Ro
(74) *Attorney, Agent, or Firm* — KUSNER & JAFFE

(57) ABSTRACT

The present invention relates to a drill bit assembly for fluid-operated percussion drill tools comprising a percussion bit having a head portion and a bit retaining portion. Engagement means are provided on the head portion engageable with complementary engagement means on a drive ring whereby rotational drive from the drive ring may be transmitted to the percussion bit. The assembly also comprises bit retaining means adapted for engagement with the bit retaining portion of the percussion bit to retain the percussion bit in the drill bit assembly. Connection means on the drive ring are adapted for connecting the drive ring to a drive means of the fluid-operated percussion drill tool. According to a first aspect, the drive ring comprises a plurality of separable part-annular drive dog segments, wherein the bit retaining means are provided on at least two of the drive dog segments. According to a second aspect the head portion of the bit comprises a main body and a plurality of bit inserts engaged therewith, and wherein the engagement means is provided by the bit inserts.

20 Claims, 21 Drawing Sheets

(56) References Cited

U.S. PATENT DOCUMENTS

| | | | | |
|---|---|---|---|---|
| 5,975,222 | A * | 11/1999 | Holte | E21B 10/36 175/286 |
| 2007/0095576 | A1 | 5/2007 | Walker et al. | |
| 2009/0255735 | A1* | 10/2009 | Swadi | E21B 10/46 175/420.1 |
| 2010/0059284 | A1 | 3/2010 | Lyon et al. | |
| 2011/0036636 | A1 | 2/2011 | Lyon | |
| 2013/0186692 | A1* | 7/2013 | Purcell | E21B 17/076 175/296 |
| 2016/0298390 | A1* | 10/2016 | Kraft | E21B 4/14 |
| 2016/0340983 | A1* | 11/2016 | Bruandet | E21B 4/14 |
| 2016/0369565 | A1* | 12/2016 | Purcell | E21B 4/14 |

OTHER PUBLICATIONS

International Preliminary Report on Patentability from corresponding International Patent Application No. PCT/EP2019/081934, dated Jan. 20, 2021.

* cited by examiner

DRILL BIT ASSEMBLY FOR PERCUSSION DRILL TOOLS

FIELD OF THE INVENTION

The present invention relates to drive arrangements for drill bits, and particularly, to drive arrangements for drill bits in large diameter fluid-operated percussion drill tools.

BACKGROUND TO THE INVENTION

Conventional down-the-hole hammers and fluid-operated percussion drill tools typically comprise an external cylinder or outer wear sleeve, within which is mounted an inner cylinder which in turn engages with a backhead assembly. A sliding reciprocating piston co-operates with the inner cylinder and backhead assembly, so that when pressure fluid is supplied through the backhead assembly, the piston acts with a percussive effect on a drill bit retained within a drive chuck on the outer wear sleeve.

The drill bit is typically formed with an axially extending shank. Axially extending splines on the shank are slideably engageable with complementary splines formed internally on the drive chuck to transmit rotational drive from the drive chuck to the bit shank. Bit retaining means, such as a bit retaining ring, engages with a shoulder at an upper end of the bit shank to retain the bit in the drill bit assembly.

For large drill bits, such as those with diameters of the order of 1.5 m, the combined weight of the bit shank and bit head can be in excess of 5000 kg. Such large bits are expensive to produce and their weight can lead to lower speed and efficiency of drilling. One way to reduce the weight of the bit is to reduce the length of the bit shank. However, reducing the length of the bit shank in such conventional arrangements is difficult because the length of the shank is related to the length of the chuck, which must be of a sufficient length to include a screw thread portion at an upper end thereof, for engagement with the wear sleeve, and sufficient splined length to transmit rotational drive effectively.

It is therefore desirable to provide a drive assembly for drill bits, particularly large diameter drill bits, that allows the bit shank to be reduced in length or eliminated.

SUMMARY OF THE INVENTION

According to an aspect of the present invention, there is provided a drill bit assembly for fluid-operated percussion drill tools comprising:

- a percussion bit having a head portion and a bit retaining portion;
- engagement means on the head portion engageable with complementary engagement means on a drive ring whereby rotational drive from the drive ring may be transmitted to the percussion bit;
- bit retaining means adapted for engagement with the bit retaining portion of the percussion bit to retain the percussion bit in the drill bit assembly; and
- connection means on the drive ring adapted for connecting the drive ring to a drive means of the fluid-operated percussion drill tool;
- wherein the drive ring comprises a plurality of separable part-annular drive dog segments, and wherein the bit retaining means are provided on at least two of the drive dog segments.

An advantage of this arrangement is that, because the engagement means are provided at the head portion of the bit, the length of the bit may be reduced, thereby reducing the overall weight of the bit, enabling faster and more efficient drilling. For example, for a 1.5 m diameter drill bit, the weight may be reduced to about 3000 kg. Furthermore, because the drive ring is provided as a plurality of drive-dog segments that can be assembled around the bit, the bit retaining means may be provided by the drive dog segments themselves, thereby obviating the need for a separate bit retaining ring.

The complementary engagement means, for engagement with the engagement means on the head portion of the bit, may be provided at a forward end of the drive ring. The complementary engagement means, for engagement with the engagement means on the head portion of the bit, may be provided on at least two of the drive dog segments. These may be the same two drive dog segments on which the bit retaining means are provided, or two different segments.

The bit retaining portion of the percussion bit may comprise a retaining shoulder. The bit retaining means may comprise a shoulder formed internally of the drive ring for engagement with the bit retaining portion of the percussion bit to retain the bit in the assembly. An advantage of this arrangement is that a separate bit retaining ring is not required. The bit retaining means, such as the shoulder, may be integrally formed with the drive ring. A shoulder portion may be formed on two or more of the drive dog segments. In a preferred embodiment, a shoulder portion is formed on each of the drive dog segments, such that when the drive ring is assembled in the assembly, a continuous shoulder is formed internally of the drive ring. Alternatively, the shoulder portion may be formed on only some of the drive dog segments, so that the shoulder is discontinuous. Preferably, the shoulder portions are positioned around the bit such that they engage the retaining shoulder of the bit in a balanced fashion.

In an embodiment, the engagement means on the head portion comprises a plurality of recesses and the complementary engagement means on the drive ring comprises a corresponding plurality of protrusions at a forward end thereof, whereby each protrusion is received within a corresponding recess to transmit rotational drive from the drive ring to the percussion bit. The protrusions may be provided in a radially spaced-apart arrangement at a forward end of the drive ring. Similarly, the recesses may be provided in a radially spaced-apart arrangement in a rearwardly-directed face of the head portion of the bit. Because the protrusions are formed at the forward end of the drive ring, and the recesses are formed on the head portion of the bit, the bit is driven as close to the cutting face as possible, thereby allowing the bit shank to be shortened or eliminated.

A protrusion may be provided on at least two of the drive dog segments. Preferably, each drive dog segment comprises one of the plurality of protrusions. Each drive dog segment may also comprise connection means for connecting the drive dog segment to a drive means of the fluid-operated percussion drill tool. Preferably, the protrusions are positioned around the bit such that they engage the recesses on the bit in a balanced fashion.

In one embodiment of the invention, the bit retaining means comprises a shoulder formed on at least two of the protrusions on the drive ring and the bit retaining portion of the percussion bit comprises a retaining shoulder formed at an opening of the corresponding recesses in the head portion of the bit. Ideally, the shoulder is formed around three sides of each of the at least two protrusions and the retaining shoulder is formed around three sides of the corresponding recesses. However, the shoulder may be formed on only one side of the protrusions and the retaining shoulder formed on a corresponding side of the recesses.

In one embodiment of the invention, the head portion of the bit comprises a main body and a plurality of bit inserts engaged therewith, wherein the engagement means is provided by the bit inserts. Preferably, the bit inserts are slidably engageable with the main body of the head portion of the bit. In other embodiments, the bit inserts may be fastened to the bit using suitable fasteners, such as bolts. The bit inserts may be provided in a radially spaced-apart arrangement at a forward end of the main body of the head portion of the percussion bit.

The engagement means on the head portion may comprise a recess provided in a rearwardly-directed face of at least two of the plurality of bit inserts and the complementary engagement means on the drive ring may comprise a corresponding plurality of protrusions at a forward end thereof, whereby each protrusion is received within a corresponding recess to transmit rotational drive from the drive ring to the percussion bit.

An advantage of this arrangement is that the inserts may be replaced as they become worn, multiple times during the lifetime of the bit, without requiring replacement of the entire bit. This is particularly advantageous for large-diameter drill bits.

In one embodiment, a recess is provided in a rearwardly-directed face of at least two of the plurality of bit inserts and a corresponding plurality of protrusions is provided at a forward end of the drive ring, wherein each of the bit inserts, recesses and protrusions is shaped such that, when the insert is engaged with the main body of the head portion of the bit, the insert is rotatable relative to the main body of the head portion of the bit. For example, at least one of the inserts, as well as the recess provided therein and the corresponding protrusion, may be substantially cylindrical in shape.

An advantage of this arrangement is that, during operation of the tool, the inserts will rotate due to rotation of the tool, thereby distributing wear over the entire surface of each insert, so that the lifetime of the inserts is increased.

According to another aspect of the invention, there is provided a drill bit assembly for fluid-operated percussion drill tools comprising:

- a percussion bit having a head portion and a bit retaining portion;
- engagement means on the head portion engageable with complementary engagement means on a drive ring whereby rotational drive from the drive ring may be transmitted to the percussion bit;
- bit retaining means adapted for engagement with the bit retaining portion of the percussion bit to retain the percussion bit in the drill bit assembly; and
- connection means on the drive ring adapted for connecting the drive ring to a drive means of the fluid-operated percussion drill tool; and
- wherein the head portion of the bit comprises a main body and a plurality of bit inserts engaged therewith, and wherein the engagement means is provided by the bit inserts.

The bit inserts may be provided in a radially spaced-apart arrangement at a forward end of the main body of the head portion of the percussion bit.

The engagement means on the head portion may comprise a recess provided in a rearwardly-directed face of at least two of the plurality of bit inserts and the complementary engagement means on the drive ring may comprise a corresponding plurality of protrusions at a forward end thereof, whereby each protrusion is received within a corresponding recess to transmit rotational drive from the drive ring to the percussion bit.

In one embodiment, a recess is provided in a rearwardly-directed face of at least two of the plurality of bit inserts and a corresponding plurality of protrusions is provided at a forward end of the drive ring, wherein each of the bit inserts, recesses and protrusions is shaped such that, when the insert is engaged with the main body of the head portion of the bit, the insert is rotatable relative to the main body of the head portion of the bit. For example, each of the inserts, recesses and protrusions may be substantially cylindrical in shape.

The bit retaining means may comprise a bit retaining ring disposed between the drive ring and an outer wear sleeve of the percussion drill tool and arranged to engage the bit retaining portion of the percussion bit to retain the bit in the assembly.

An advantage of this arrangement is that the inserts may be replaced as they become worn, multiple times during the lifetime of the bit, without requiring replacement of the entire bit. This is particularly advantageous for large-diameter drill bits. Because drive is transferred from the drive ring to the inserts, which form part of the head portion of the bit, the length of the bit may be reduced, thereby reducing the overall weight of the bit, enabling faster and more efficient drilling.

According to another aspect of the invention, there is provided a drill bit assembly for fluid-operated percussion drill tools comprising:

- a percussion bit having a head portion and a bit retaining portion;
- engagement means on the head portion engageable with complementary engagement means on a drive ring whereby rotational drive from the drive ring may be transmitted to the percussion bit;
- bit retaining means adapted for engagement with the bit retaining portion of the percussion bit to retain the percussion bit in the drill bit assembly; and
- an internal screw-thread provided at an upper part of the drive ring for connecting the drive ring to an external screw-thread provided at a lower end of an outer wear sleeve of the fluid-operated percussion drill tool, such that the bit retaining means is retained between the outer wear sleeve and a shoulder formed internally of the drive ring.

An advantage of this arrangement is that the length of the bit may be reduced as compared with conventional splined arrangements.

In an embodiment, the bit retaining means may be retained between a lower end of the outer wear sleeve and the shoulder formed internally of the drive ring. A further advantage of this arrangement is that the bit retaining ring need not be accommodated within the inner diameter of the wear sleeve. In other embodiments, the bit retaining means may be retained between a shoulder formed internally of the wear sleeve and the shoulder formed internally of the drive ring.

The engagement means on the head portion may comprise a plurality of recesses and the complementary engagement means on the drive ring may comprise a corresponding plurality of protrusions at a forward end thereof, whereby each protrusion is received within a corresponding recess to transmit rotational drive from the drive ring to the percussion bit. The protrusions may be provided in a radially spaced-apart arrangement at a forward end of the drive ring and the recesses may be provided in a radially spaced-apart arrangement in a rearwardly-directed face of the head portion of the bit.

The bit retaining means may comprise a bit retaining ring disposed between the drive ring and an outer wear sleeve of the percussion drill tool and arranged to engage the bit retaining portion of the percussion bit to retain the bit in the assembly. The bit retaining portion of the percussion bit may comprise a retaining shoulder.

According to another aspect of the invention, there is provided a down-the-hole hammer comprising an external cylindrical outer wear sleeve, a sliding piston mounted for reciprocating movement within the outer wear sleeve to strike a percussion bit of a drill bit assembly located at the forward end of the outer wear sleeve wherein the drill bit assembly is an assembly as described above.

DETAILED DESCRIPTION OF THE DRAWINGS

Figure 1:
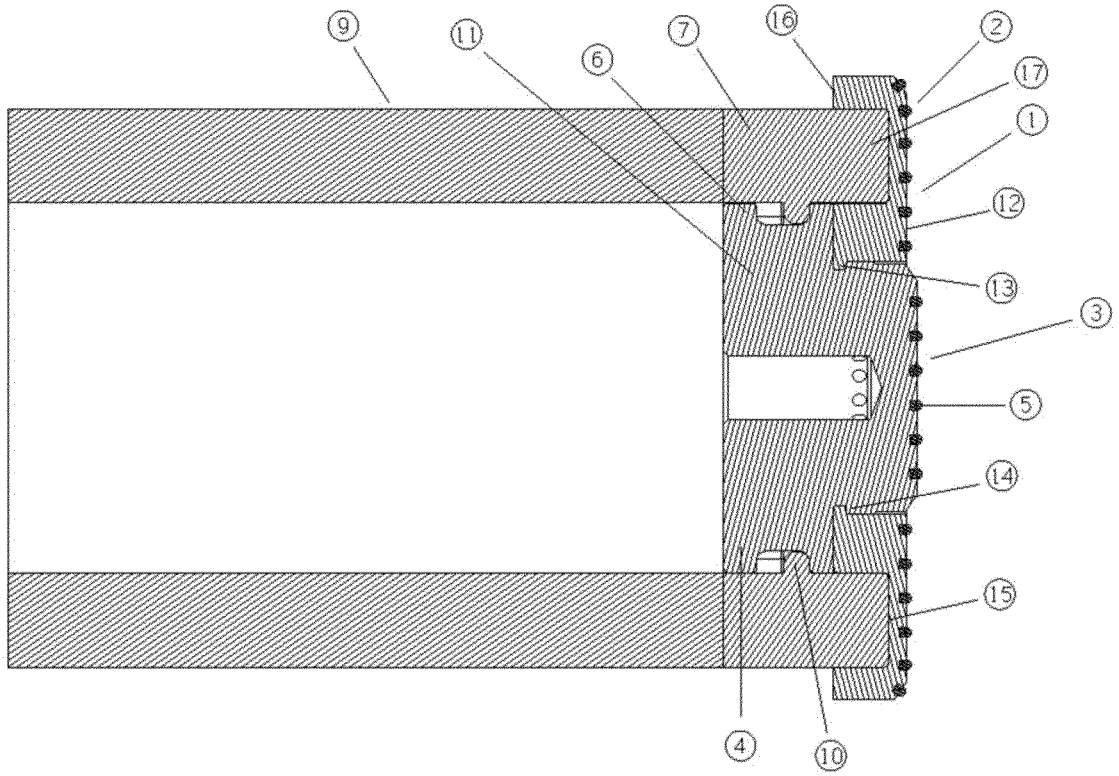
FIG. 1 is a longitudinal cross-section of a drill bit assembly according to a first embodiment of the invention, attached to a wear sleeve of a percussion drill tool.

Referring to FIGS. 1 to 7 of the drawings, there is illustrated a drill bit assembly 1 of a fluid-operated percussion drill tool according to a first embodiment of the present invention. The assembly comprises a percussion bit 2 having a head portion 3 and a bit retaining portion 4. The head portion 3 of the bit assembly is provided with tungsten carbide buttons 5, in a well-known manner. The bit retaining portion 4 of the percussion bit comprises a retaining shoulder 6.

Figure 2:
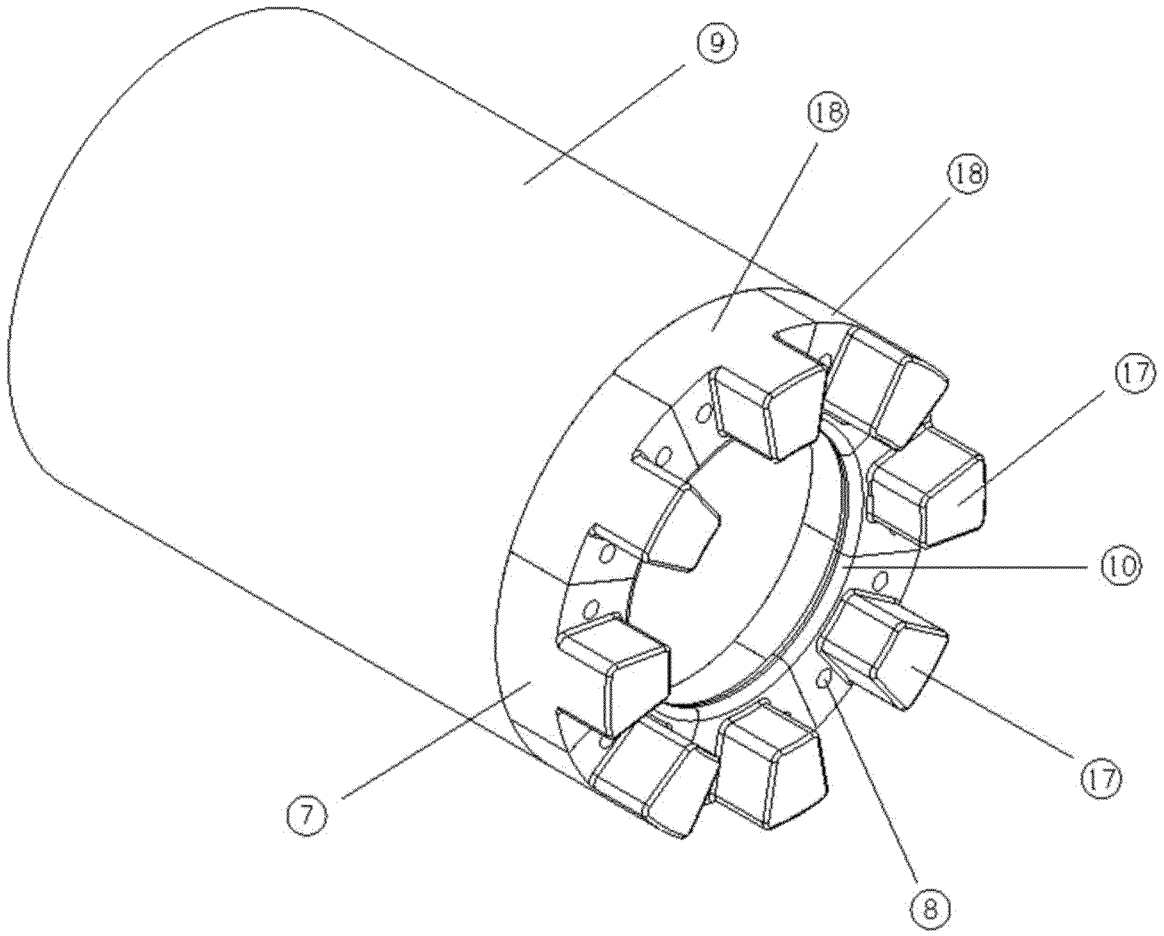
FIG. 2 is a perspective view of a drive ring of the drill bit assembly of FIG. 1 attached to the wear sleeve.

The assembly further comprises a drive ring 7 for transmission of rotational drive to the percussion bit. As shown in FIG. 2, in this embodiment, the drive ring 7 comprises a plurality of separable drive dog segments 18 which together form an annular drive ring. The drive ring 7 is bolted via holes 8 in each segment 18 to an outer wear sleeve 9 of the percussion drill tool to enable rotational torque to be transmitted from the wear sleeve through the drive ring 7 to the bit 1. Each of the drive dog segments is formed with an internal shoulder portion 10 which, when the drive ring is assembled, together form a continuous shoulder that engages with the retaining shoulder 6 of the percussion bit to retain the bit in the assembly. In alternate embodiments, the shoulder portions 10 may be formed only on some of the drive dog segments, which may be positioned around the bit such that they engage the retaining shoulder 6 in a balanced fashion.

Figure 3:
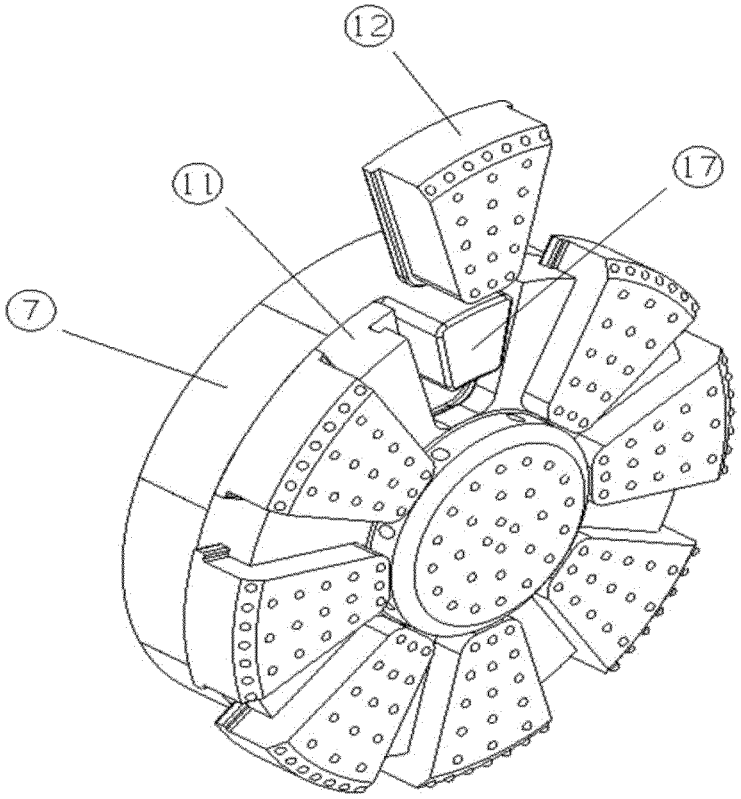
FIG. 3 is a perspective view of the drive ring and percussion bit of the drill bit assembly of FIG. 1.

The head portion 3 of the bit comprises a main body 11 and a plurality of bit inserts 12 slidably engaged therewith. The bit inserts 12 are retained in the main body 11 by way of lips 13 on the inserts, which engage with complementary shoulders 14 on the main body 11. As best shown in FIG. 3, the bit inserts 12 are provided in a radially spaced-apart arrangement at a forward end of the main body 11 of the head portion 3 of the percussion bit 1. Together, a central portion of the main body 11 and the bit inserts 12 make up a cutting face of the bit 2.

Figure 4:
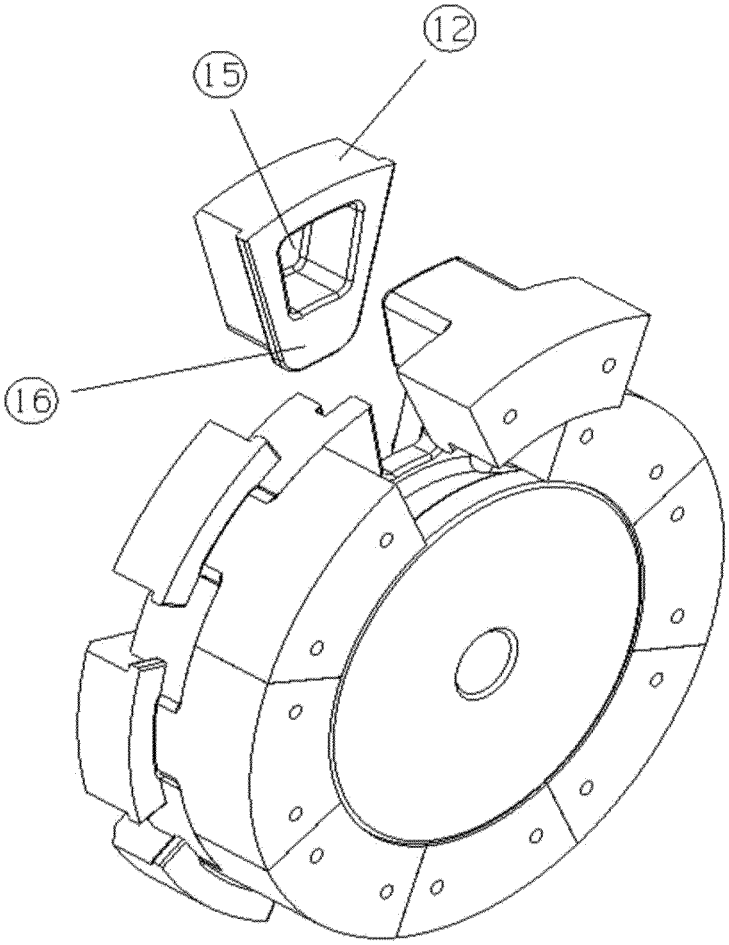
FIG. 4 is a reverse perspective view of the drive ring and percussion bit of the drill bit assembly of FIG. 1.
Figure 5:
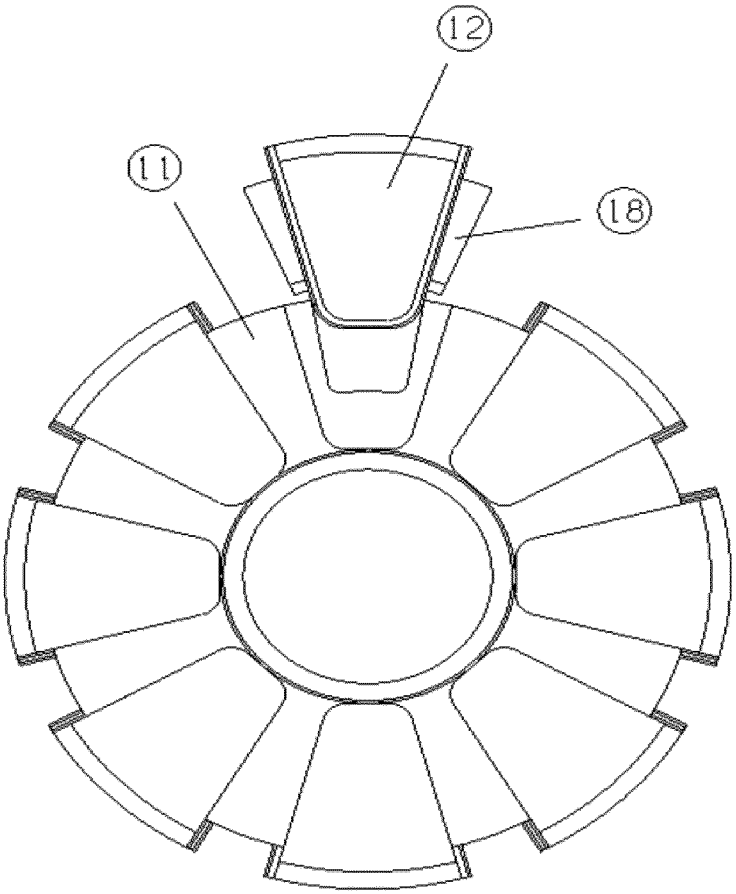
FIG. 5 is a bottom plan view of the drill bit assembly of FIG. 1, during assembly.

As shown in FIG. 4, a recess 15 is provided in a rearwardly-directed face 16 of each of the plurality of bit inserts 12. The drive ring 7 is provided with a corresponding plurality of protrusions 17 at a forward end thereof. Each drive dog segment 18 comprises one of the plurality of protrusions. When the assembly is assembled, each protrusion 17 is received within a corresponding recess 15 to transmit rotational drive from the drive ring to the percussion bit.

Figure 6:
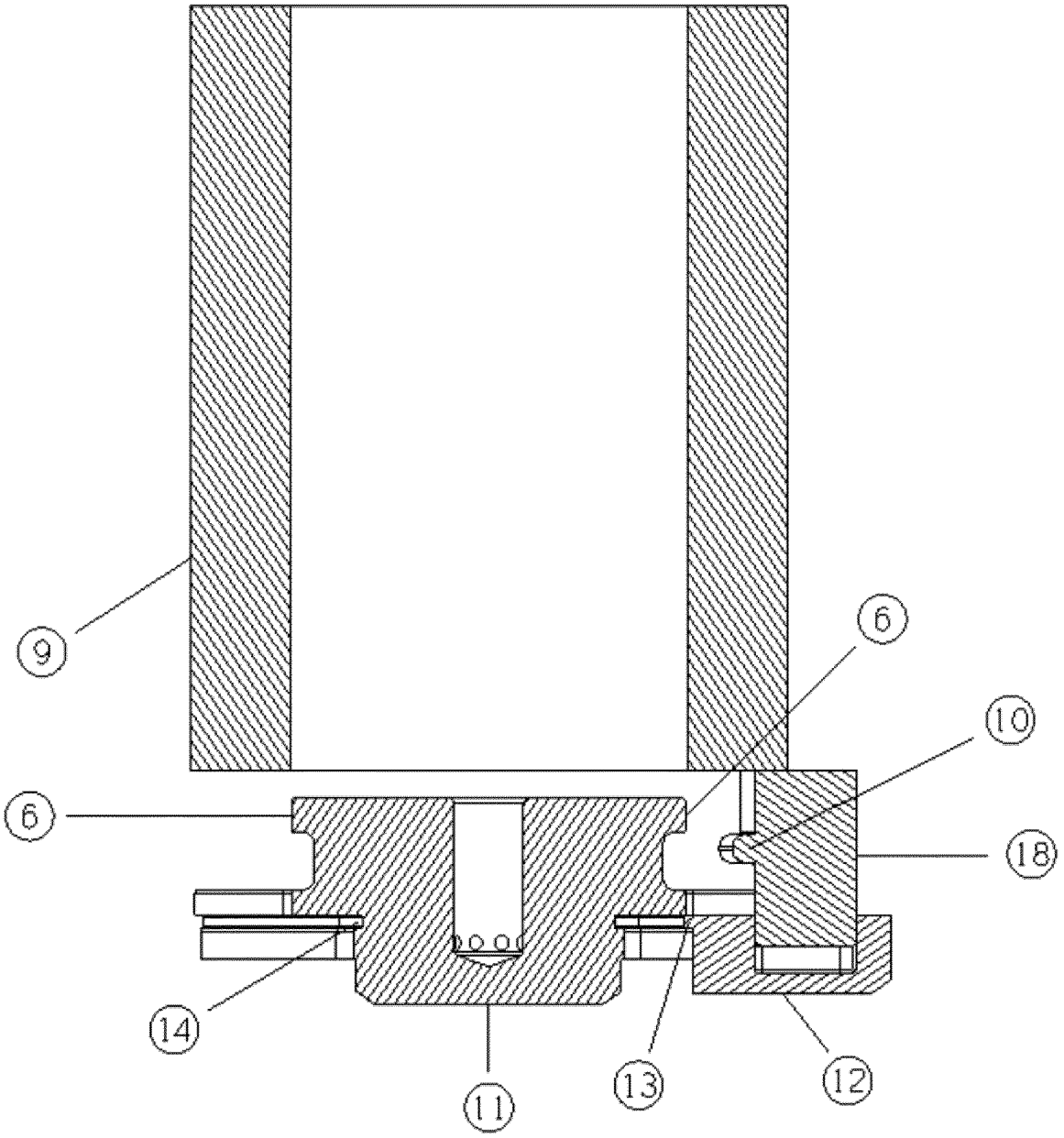
FIG. 6 is a longitudinal cross-section of the drill bit assembly and wear sleeve of FIG. 1, during assembly.
Figure 7:
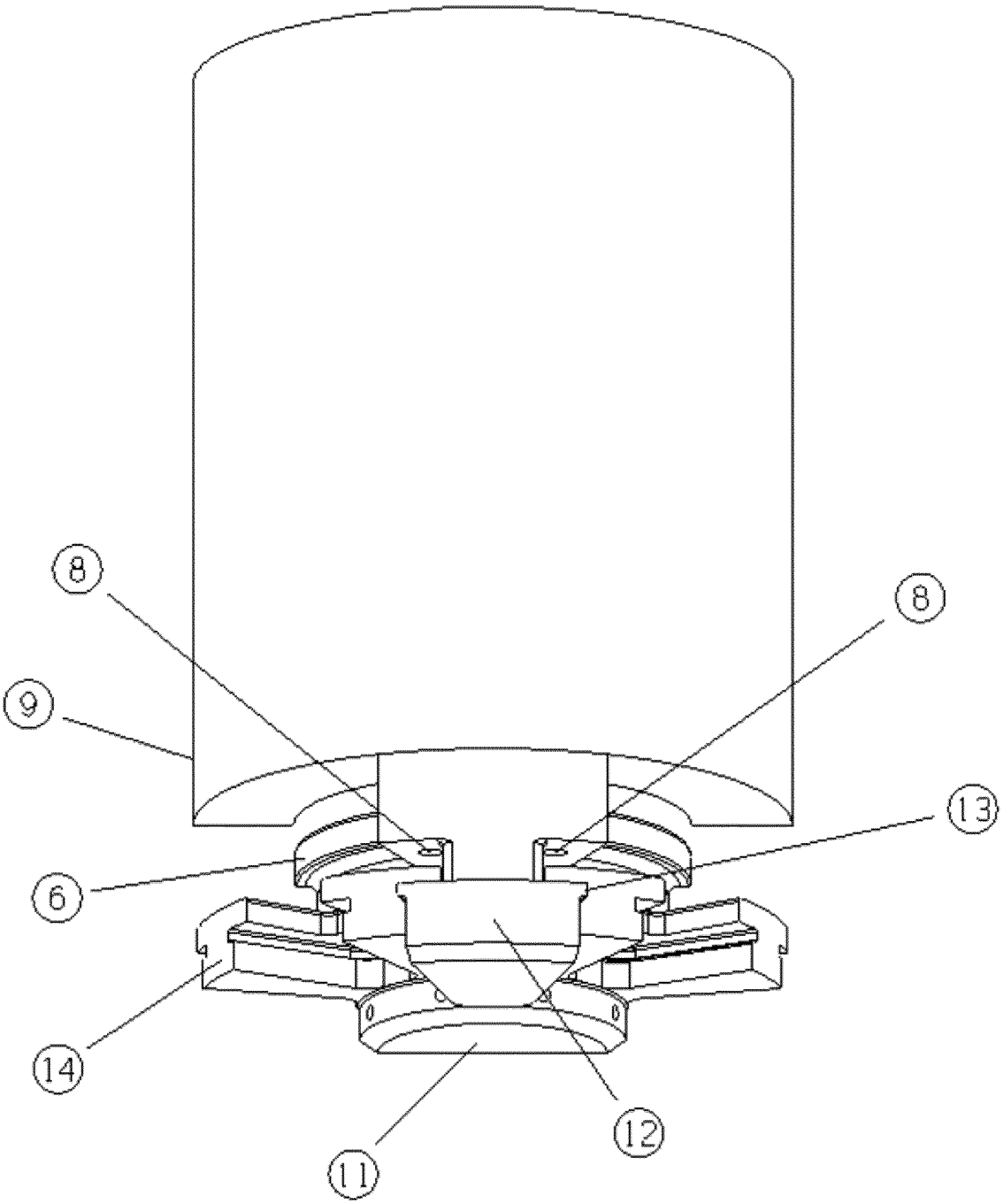
FIG. 7 is a cutaway perspective view of the drill bit assembly and wear sleeve of FIG. 1, during assembly.
Figure 8:
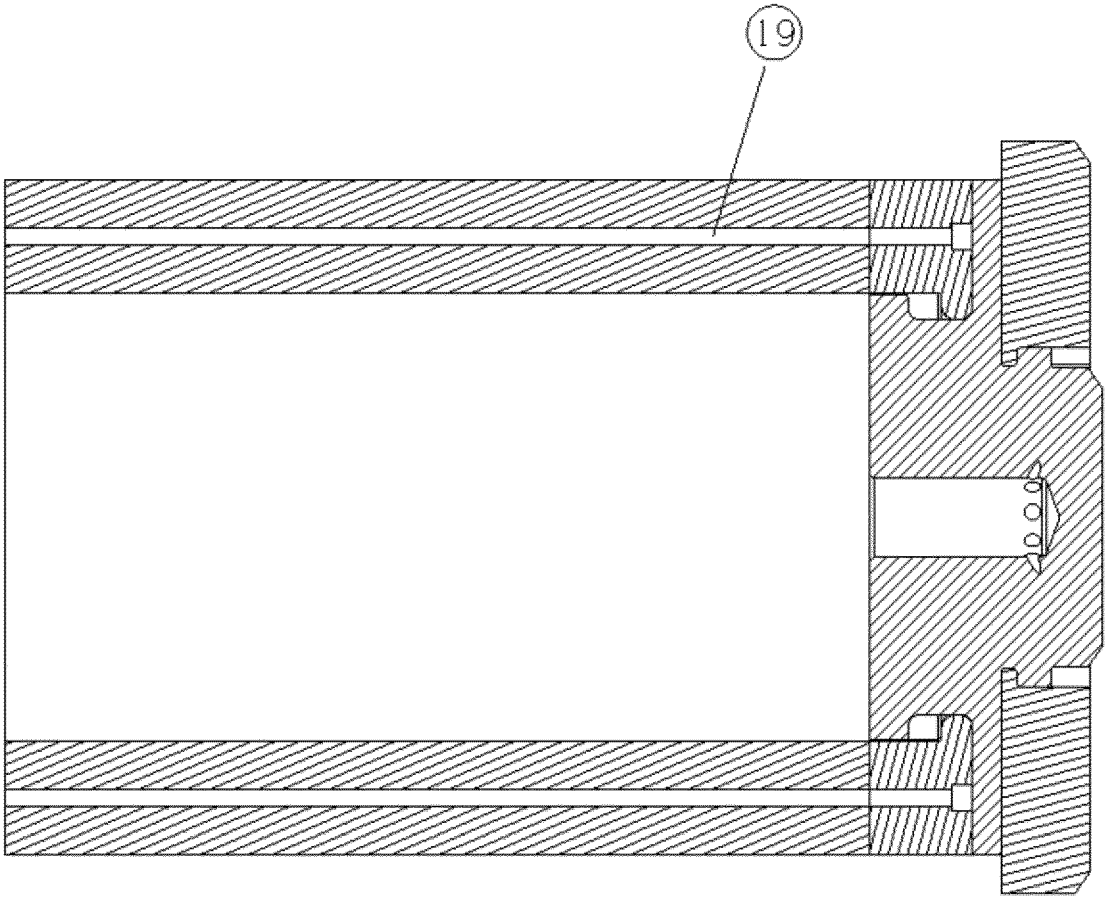
FIG. 8 is a longitudinal cross-section of a drill bit assembly according to a second embodiment of the invention, attached to a wear sleeve of a percussion drill tool.

To assemble the drill bit assembly of the first embodiment, the drill bit 1 is positioned relative to the wear sleeve 9 in the drop-out position as shown in FIGS. 6 and 7. A single drive dog segment 18 and a single bit insert 12 are assembled together and slid into the main body of the head portion 3 of the bit, such that a lip 13 of the insert engages with a shoulder 14 of the main body 11 and shoulder portion 10 on the drive dog segment engages with retaining shoulder 6 on the bit. The drive dog segment 18 is then bolted to the wear sleeve 9 via holes 8 which can be accessed externally as shown in FIG. 7. An alternate embodiment is shown in FIG. 8, in which large bolts 19 are screwed in from the top of the wear sleeve down into the drive dogs to retain the drive dogs in the assembly.

Each pair of drive dog segment and bit insert is added in the same way. Once all of the drive dog segments have been added, the drive dog segments form a continuous annular drive ring 7. The drive ring is retained in the assembly by way of the bolts and the drive ring in turn retains the percussion bit 1 in the assembly. The inserts are engaged with the main body of the bit by way of lips 13 and shoulders 14. Rotational drive is transmitted from the drive ring 7 to the bit 1 by engagement of the protrusions 17 with the recesses 15 in the bit inserts.

Figure 9:
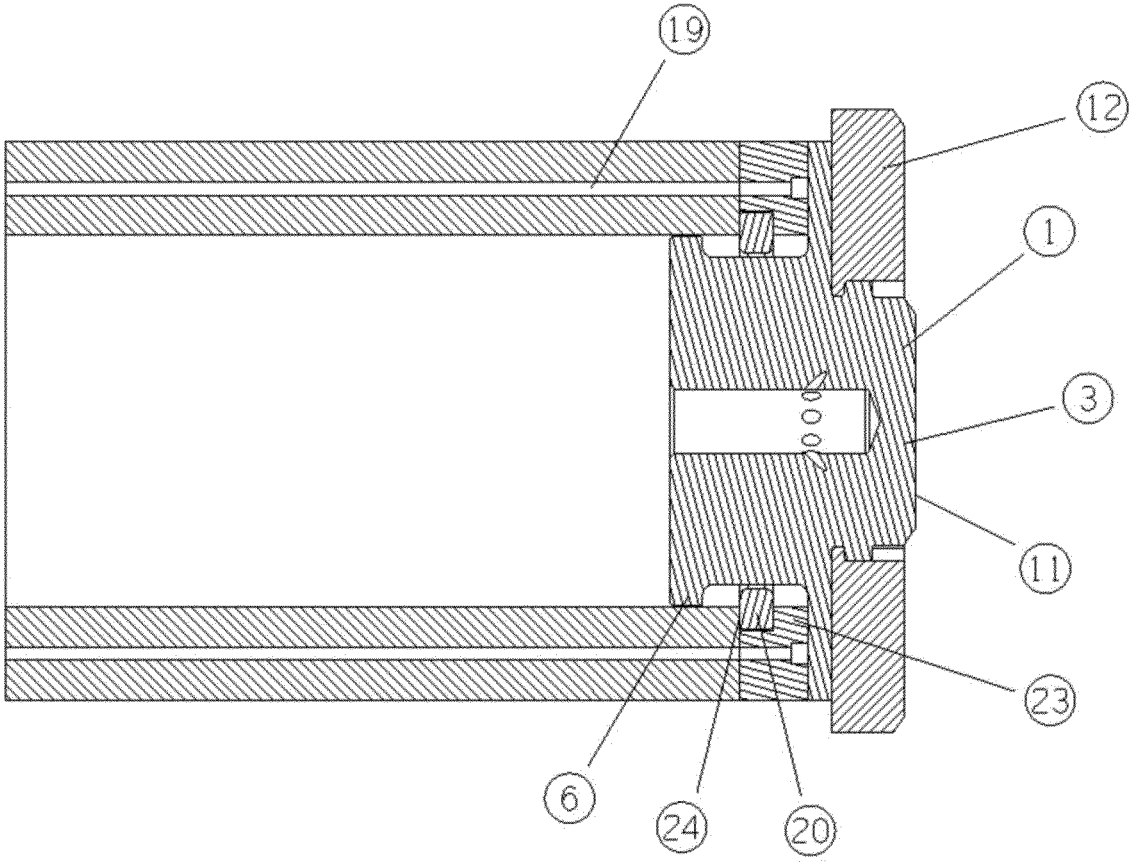
FIG. 9 is a longitudinal cross-section of a drill bit assembly according to a third embodiment of the invention, attached to a wear sleeve of a percussion drill tool.

A drill bit assembly according to a third embodiment of the invention is shown in FIG. 9. This embodiment differs from the embodiment shown in FIGS. 1 to 7 in that the drive ring 7 is formed as a single piece and a bit retaining ring 20 is provided between the outer wear sleeve 9 and a shoulder 23 formed internally of the drive ring 7 to retain the bit 1 in the assembly. The bit retaining ring is provided as a plurality of part-annular portions, to allow it to be inserted into the assembly. To assemble the assembly of FIG. 9, the inserts 12 are first slideably engaged with the main body 11 of the bit. The drive ring is then set on top of the bit and the part annular-portions of the bit retaining ring 20 are inserted between the bit and the drive ring, such that the bit retaining ring 20 sits on shoulder 23 of the drive ring. Similar to the embodiment shown in FIG. 8, large bolts 19 are screwed in from the top of the wear sleeve down into the drive ring to retain the drive ring in the assembly. The bit retaining ring is retained in the assembly between a lower end 24 of the wear sleeve and shoulder 23 of the drive ring. In an alternate embodiment, in place of the bolts 19, the wear sleeve and the drive ring may be clamped together temporarily, and the bit allowed to drop out so that the drive ring may be bolted in from a forward end thereof, as in FIGS. 1 to 7.

Figure 10:
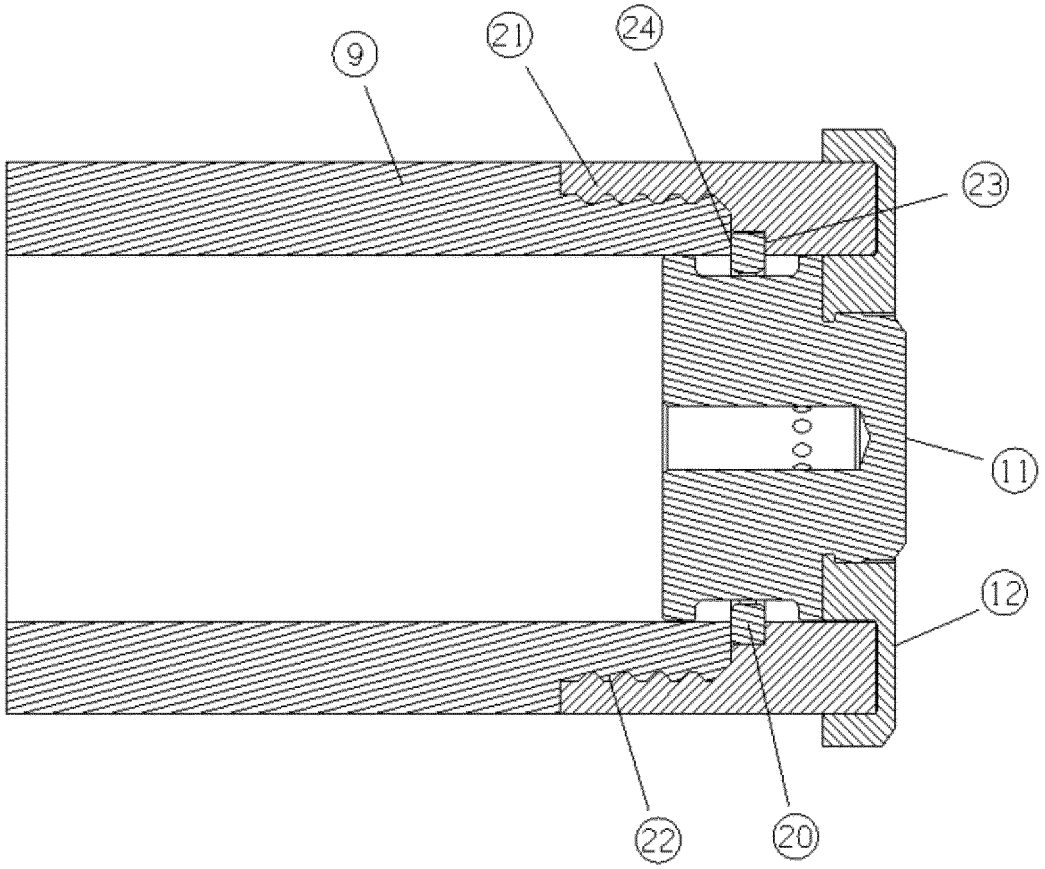
FIG. 10 is a longitudinal cross-section of a drill bit assembly according to a fourth embodiment of the invention, attached to a wear sleeve of a percussion drill tool.

A drill bit assembly according to a fourth embodiment of the invention is shown in FIG. 10. In this embodiment, an upper part 21 of the single-piece drive ring 7 is internally screw threaded. An external screw-thread 22 is provided on a lower portion of the wear sleeve 9. The drive ring 7 is screwed onto the lower end of the wear sleeve so that the retaining ring 20 is held in place between shoulder 23 on the drive ring 7 and a lower end 24 of the wear sleeve. The screw-threaded engagement of the drive ring 7 with the wear sleeve enables rotational torque to be transmitted from the wear sleeve through the drive ring to the bit 1.

Figure 11:
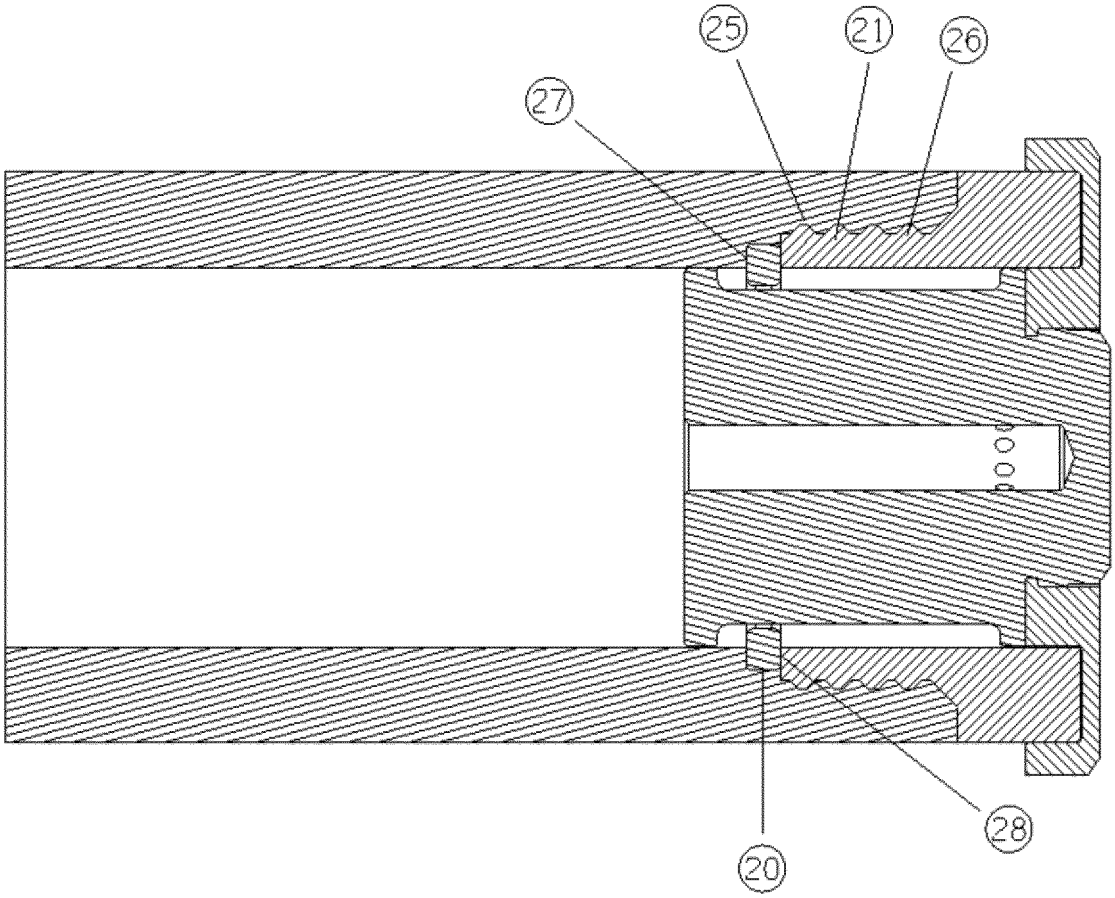
FIG. 11 is a longitudinal cross-section of a drill bit assembly according to a fifth embodiment of the invention, attached to a wear sleeve of a percussion drill tool.

A drill bit assembly according to a fifth embodiment of the invention is shown in FIG. 11. In this embodiment, an upper part 21 of the single-piece drive ring 7 is provided with an external screw thread 26. An internal screw-thread 25 is provided on a lower portion of the wear sleeve 9. The drive ring 7 is screwed into the lower end of the wear sleeve so that the retaining ring 20 is held in place between shoulder 27 on the wear sleeve 9 and an upper end 28 of the drive ring. The screw-threaded engagement of the drive ring 7 with the wear sleeve enables rotational torque to be transmitted from the wear sleeve through the drive ring to the bit 1.

Figure 12:
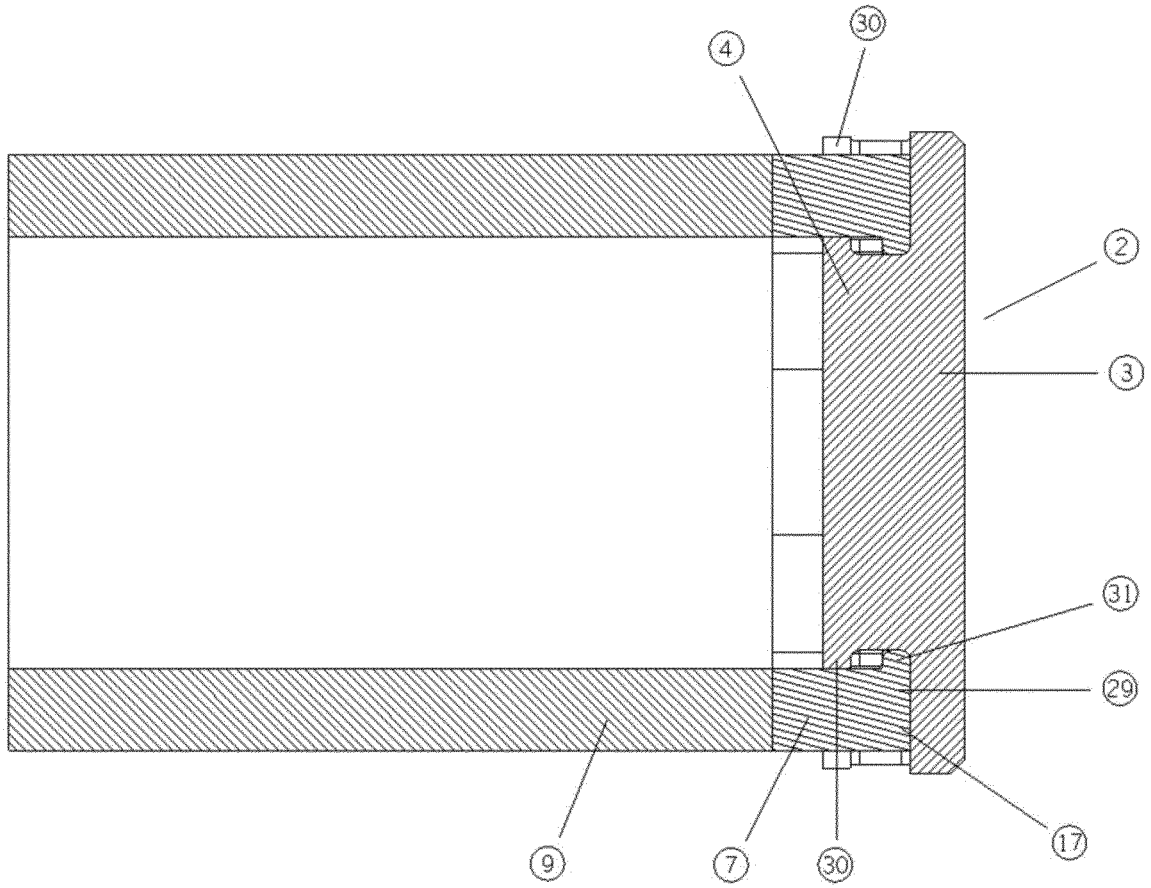
FIG. 12 is a longitudinal cross-section of a drill bit assembly according to a sixth embodiment of the invention, attached to a wear sleeve of a percussion drill tool.
Figure 13:
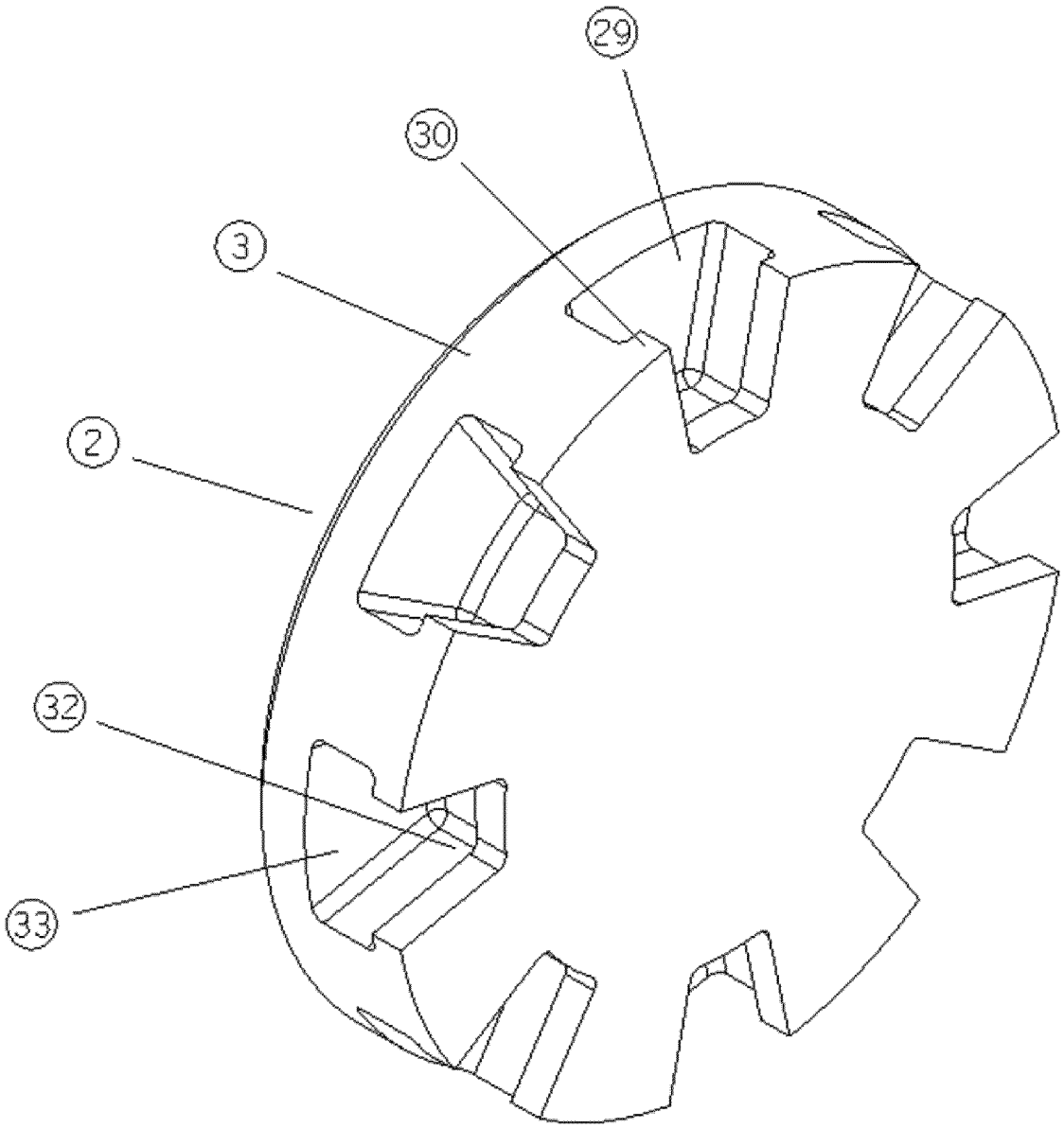
FIG. 13 is a perspective view of the drill bit of the drill bit assembly of FIG. 12.

A drill bit assembly according to a sixth embodiment of the invention is shown in FIGS. 12 to 15. As shown in FIGS. 12 and 13, the percussion bit 2 is generally cylindrical and is formed with a bit head portion 3 at a forward end thereof and a bit retaining portion 4 at a rear end thereof. The bit 2 is formed as a single piece having a plurality of recesses 29 provided in a radially spaced-apart arrangement at a rear end of the bit. Each recess has an opening 32 in a rear face of the bit 2 and an opening 33 in a curved face of the bit 2. A retaining shoulder or lip 30 is formed at the opening 32 of each recess in the rear face of the bit, and the shoulders 30 form the bit retaining portion 4 of the bit 2. The shoulder 30 associated with each recess extends towards the centre of that recess. In the embodiment shown, each shoulder 30 extends around three sides of each recess. In alternate embodiments, the shoulder may be provided only at one side of the recess, such as the innermost side, opposite the opening 33.

Figure 14:
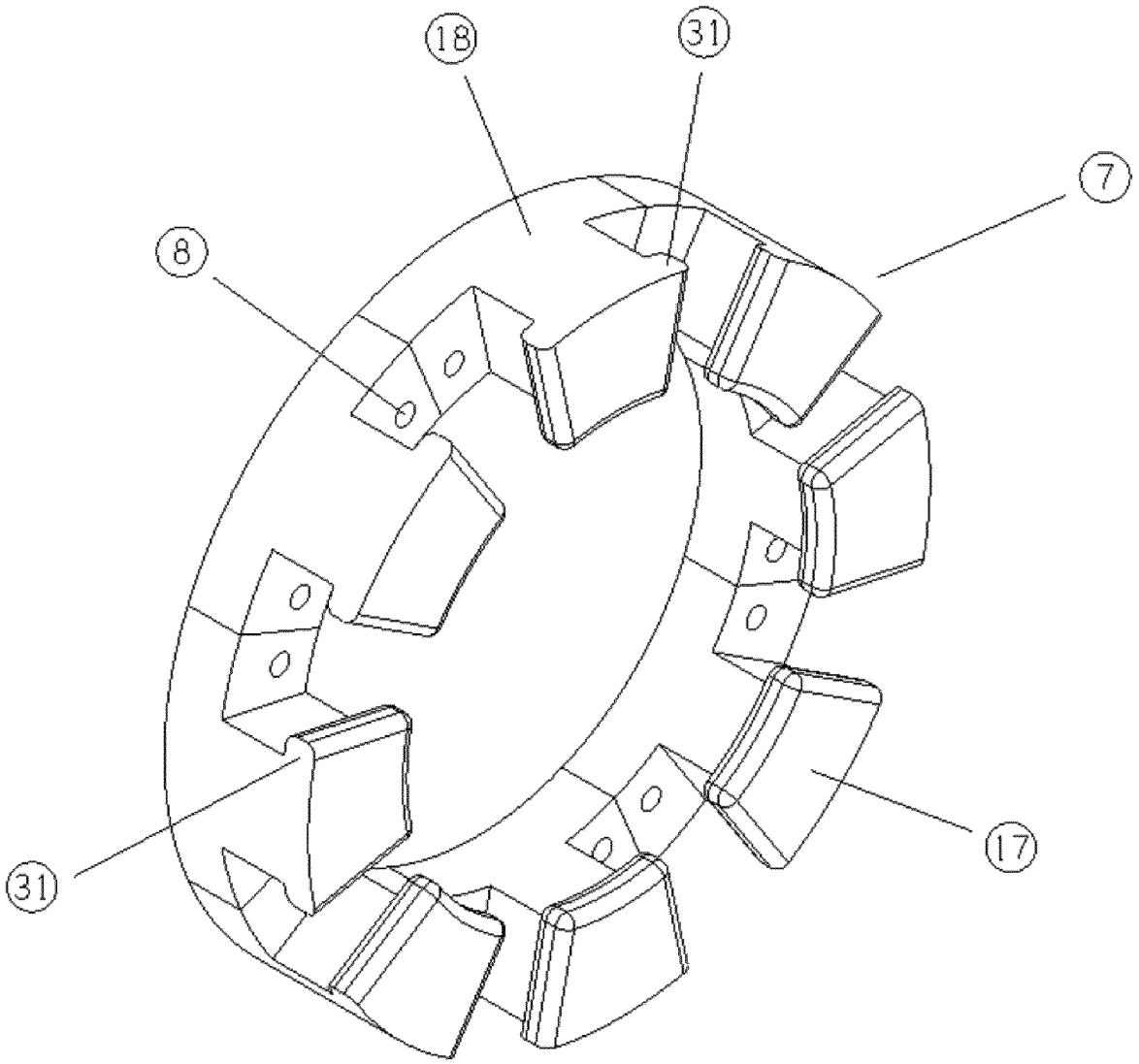
FIG. 14 is a perspective view of the drive ring of the drill bit assembly of FIG. 12.

The assembly further comprises a drive ring 7 for transmission of rotational drive from to the percussion bit. As shown in FIG. 14, the drive ring 7 comprises a plurality of part-annular drive dog segments 18 which together form an annular drive ring. The drive ring 7 is bolted via holes 8 in each segment 18 to an outer wear sleeve 9 of the percussion drill tool to enable rotational torque to be transmitted from the wear sleeve through the drive ring 7 to the bit 1.

Figure 15:
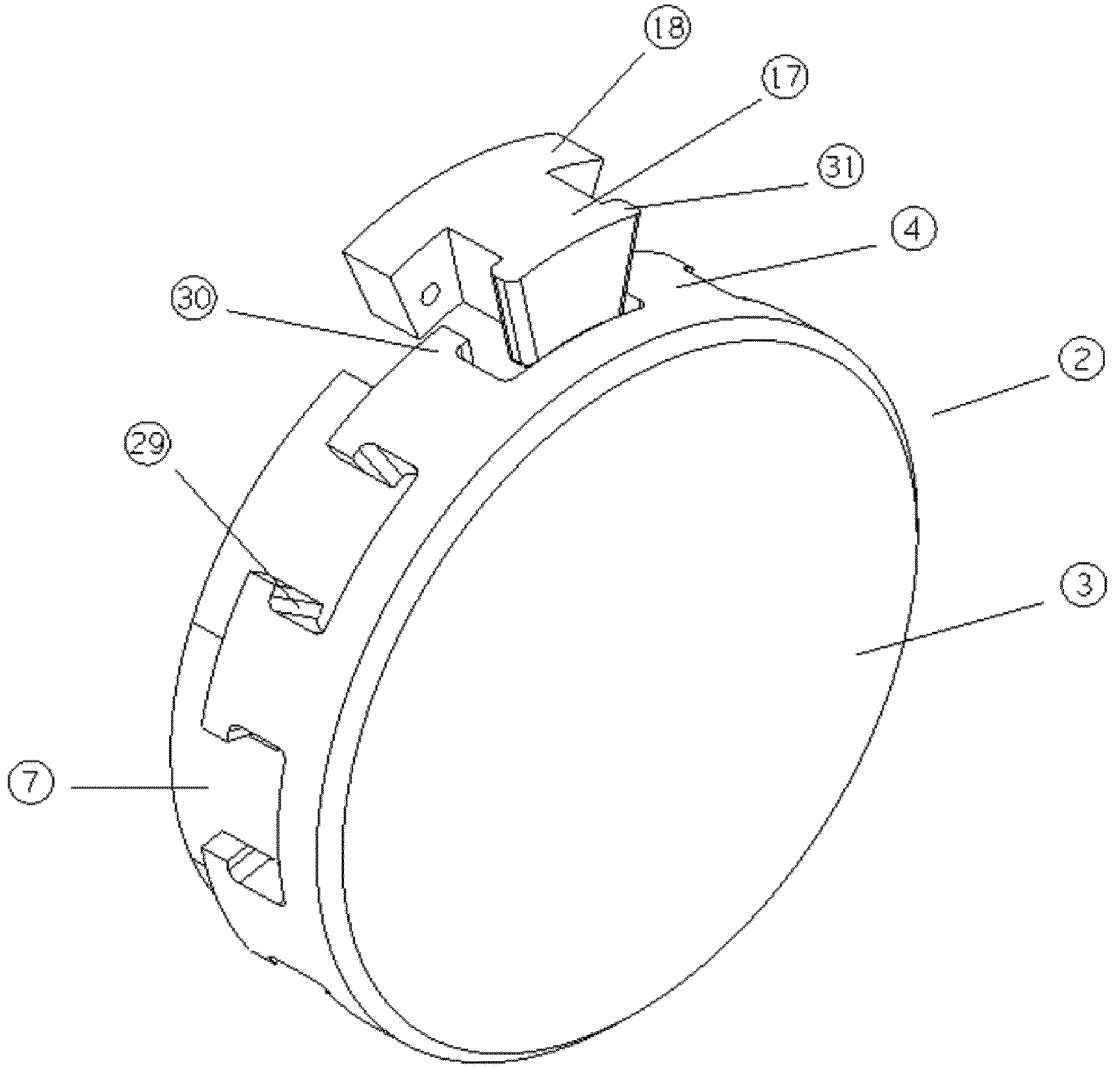
FIG. 15 is a perspective view of the drive ring and bit of the drill bit assembly of FIG. 12, during assembly.

The drive ring 7 is provided with a plurality of protrusions 17 at a forward end thereof, the protrusions corresponding in number and dimension to the recesses 29 in the percussion bit. Each drive dog segment 18 comprises one of the plurality of protrusions. When the assembly is assembled, each protrusion 17 is received within a corresponding recess 29 to transmit rotational drive from the drive ring to the percussion bit. Each protrusion 17 is formed with a shoulder 31 at a free end thereof. In the embodiment shown, the shoulder 31 extends around three sides of the protrusion 17. In alternate embodiments, the shoulder 31 may be provided only at one side of the protrusion, such as the innermost side of the protrusion. As shown in FIG. 15, when the drive dog segments are assembled with the bit 2, the shoulders 31 engage with the retaining shoulders 30 of the percussion bit to retain the bit in the assembly.

To assemble the drill bit assembly according to the sixth embodiment of the invention, the drill bit 1 is positioned relative to the wear sleeve 9 in the drop-out position. A single drive dog segment 18 is slid into one of the recesses 29 in the bit, such that shoulder 31 on the drive dog segment engages with retaining shoulder 30 on the bit. The drive dog segment 18 is then bolted to the wear sleeve 9 via holes 8 which can be accessed externally. Alternatively, large bolts are screwed in from the top of the wear sleeve down into the drive dogs to retain the drive dogs in the assembly.

Each drive dog segment is added in the same way. Once all of the drive dog segments have been added, the drive dog segments form a continuous annular drive ring 7. The drive ring is retained in the assembly by way of the bolts and the drive ring in turn retains the percussion bit 1 in the assembly by engagement of shoulders 31 with shoulders 30 on the bit. Rotational drive is transmitted from the drive ring 7 to the bit 1 by engagement of the protrusions 17 with the recesses 29 in the bit.

Figure 16:
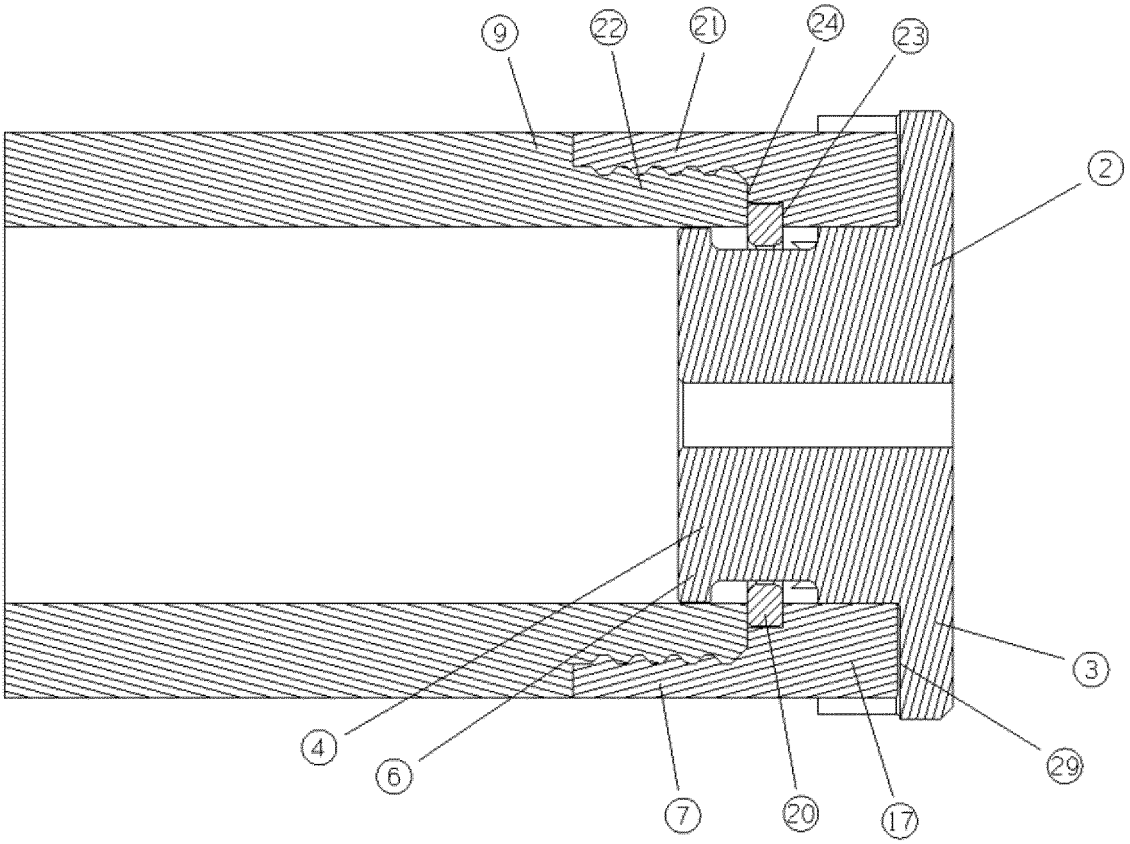
FIG. 16 is a longitudinal cross-section of a drill bit assembly according to a seventh embodiment of the invention, attached to a wear sleeve of a percussion drill tool.
Figure 17:
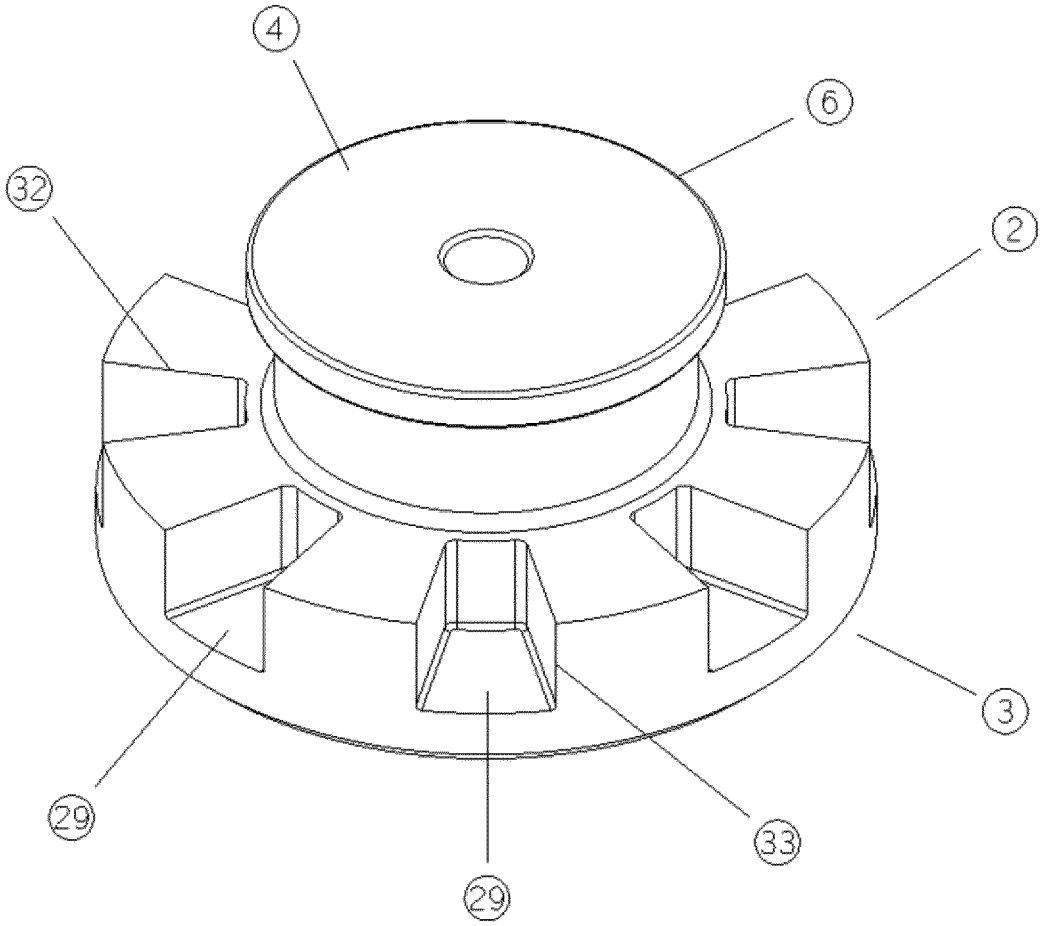
FIG. 17 is a perspective view of the drill bit of the drill bit assembly of FIG. 16.

A drill bit assembly according to a seventh embodiment of the invention is shown in FIGS. 16 and 17. As shown in these figures, the percussion bit 2 is formed with a bit head portion 3 at a forward end thereof and a bit retaining portion 4 at a rear end thereof. The bit retaining portion 4 of the percussion bit comprises a retaining shoulder 6. The bit 2 is formed as a single piece having a plurality of recesses 29 provided in a radially spaced-apart arrangement at a rear end of the bit. Each recess has an opening 32 in a rear face of the bit 2 and an opening 33 in a curved face of the bit 2.

The assembly further comprises a drive ring 7 for transmission of rotational drive to the percussion bit. The drive ring 7 is provided with plurality of protrusions 17 at a forward end thereof, corresponding to the recesses 29 in the bit 2. As in the embodiment shown in FIG. 9, the drive ring 7 is formed as a single piece and a bit retaining ring 20 is provided between the outer wear sleeve 9 and a shoulder 23 formed internally of the drive ring 7 to retain the bit 2 in the assembly. The bit retaining ring is provided as a plurality of part-annular portions, to allow it to be inserted into the assembly.

To assemble the assembly of FIG. 16, the drive ring is set on top of the bit such that each protrusion 17 on the drive ring is received in a recess 29 formed in the bit and the part annular-portions of the bit retaining ring 20 are inserted between the bit and the drive ring, such that the bit retaining ring 20 sits on shoulder 23 of the drive ring. An upper part 21 of the single-piece drive ring 7 is internally screw threaded. An external screw-thread 22 is provided on a lower portion of the wear sleeve 9. The drive ring 7 is screwed onto the lower end of the wear sleeve so that the retaining ring 20 is held in place between shoulder 23 on the drive ring 7 and a lower end 24 of the wear sleeve. The screw-threaded engagement of the drive ring 7 with the wear sleeve enables rotational torque to be transmitted from the wear sleeve through the drive ring to the bit 1.

Referring to FIGS. 18 to 21 of the drawings, there is illustrated a drill bit assembly 1 of a fluid-operated percussion drill tool according to an eighth embodiment of the present invention. The assembly comprises a percussion bit 2 having a head portion 3 and a bit retaining portion 4. The bit retaining portion 4 of the percussion bit comprises a retaining shoulder 6.

Figure 19:
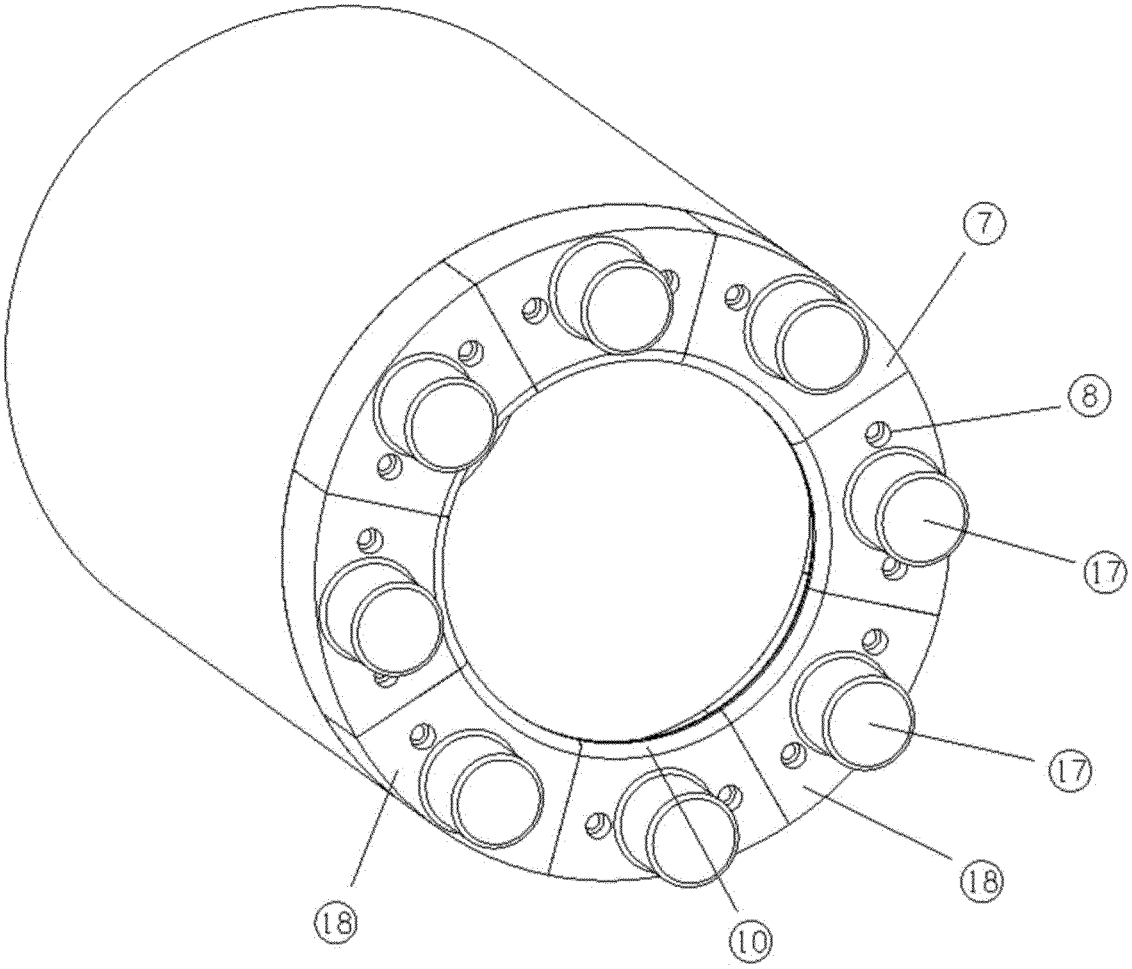
FIG. 19 is a perspective view of the drive ring of the drill bit assembly of FIG. 18, attached to the wear sleeve.

The assembly further comprises a drive ring 7 for transmission of rotational drive to the percussion bit. As shown in FIG. 19, in this embodiment, the drive ring 7 comprises a plurality of separable drive dog segments 18 which together form an annular drive ring. The drive ring 7 is bolted via holes 8 in each segment 18 to an outer wear sleeve 9 of the percussion drill tool to enable rotational torque to be transmitted from the wear sleeve through the drive ring 7 to the bit 1. Each of the drive dog segments is formed with an internal shoulder portion 10 which, when the drive ring is assembled, together form a continuous shoulder that engages with the retaining shoulder 6 of the percussion bit to retain the bit in the assembly. In alternate embodiments, the shoulder portions 10 may be to formed only on some of the drive dog segments, which may be positioned around the bit such that they engage the retaining shoulder 6 in a balanced fashion.

Figure 20:
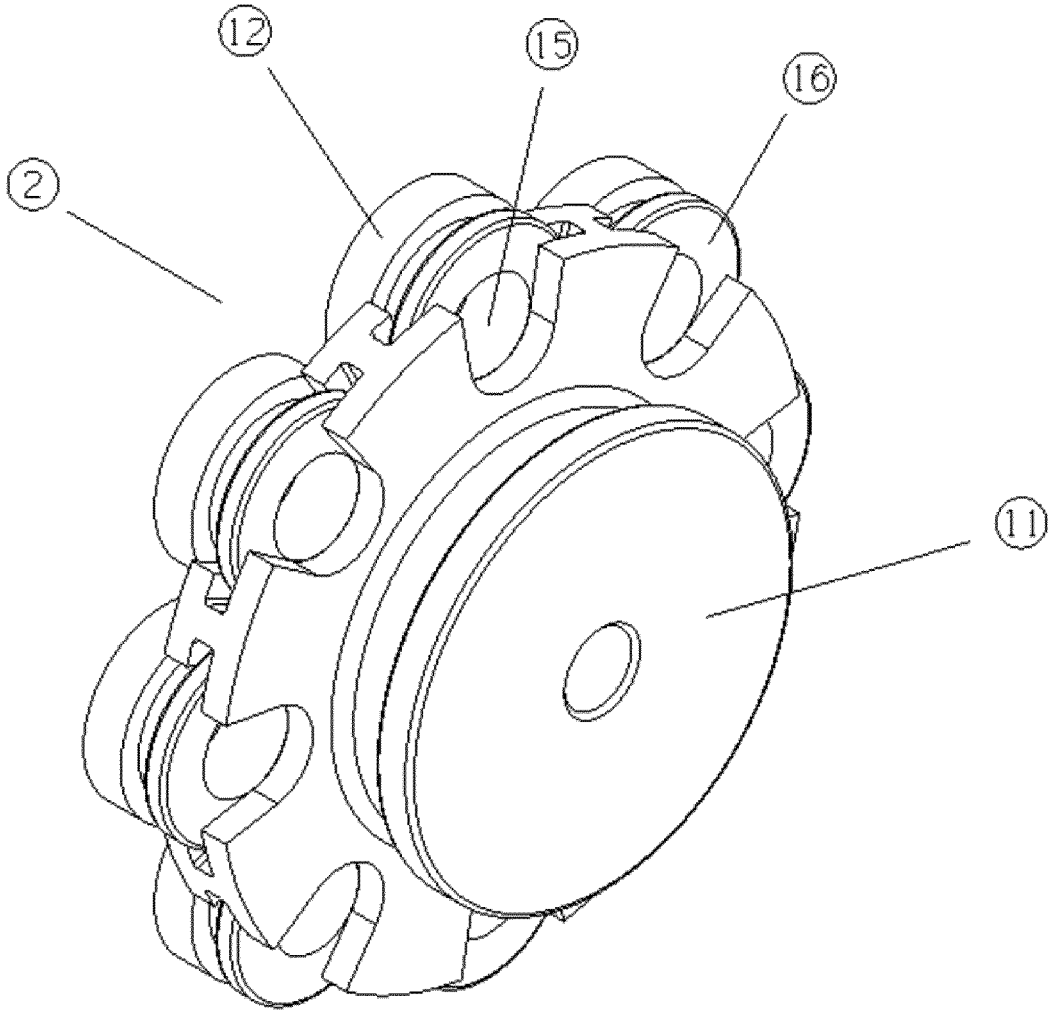
FIG. 20 is a reverse perspective view of the percussion bit of the drill bit assembly of FIG. 18.
Figure 21:
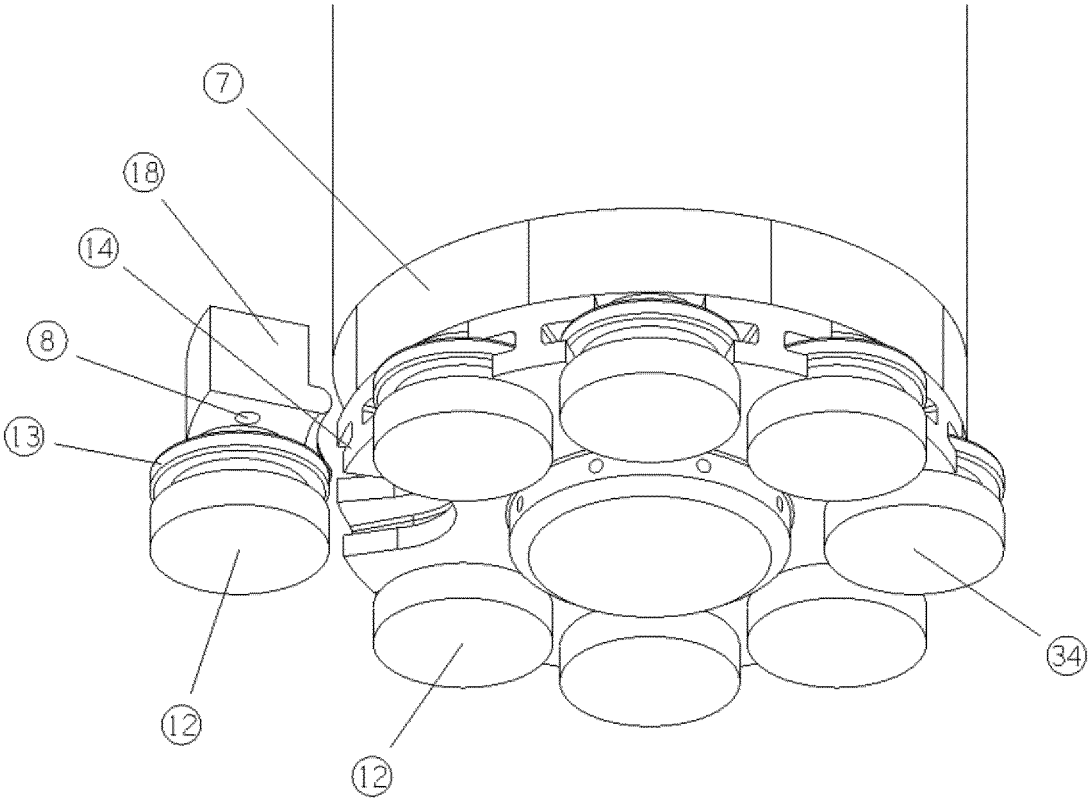
FIG. 21 is a perspective view of the drill bit assembly of FIG. 18, during assembly.

The head portion 3 of the bit comprises a main body 11 and a plurality of bit inserts 12 slidably engaged therewith. In this embodiment, the bit inserts are substantially cylindrical in shape, with a disc-shaped cutting face 34 at a forward end. Each bit insert 12 is retained in the main body 11 by way of a lip 13 around the circumference of the insert, which engages with a complementary shoulder 14 on the main body 11. As best shown in FIGS. 20 and 21, the bit inserts 12 are provided in a radially spaced-apart arrangement at a forward end of the main body 11 of the head portion 3 of the percussion bit 1. A central portion of the main body 11, together with the bit inserts 12, makes up a cutting face of the bit 2.

Figure 18:
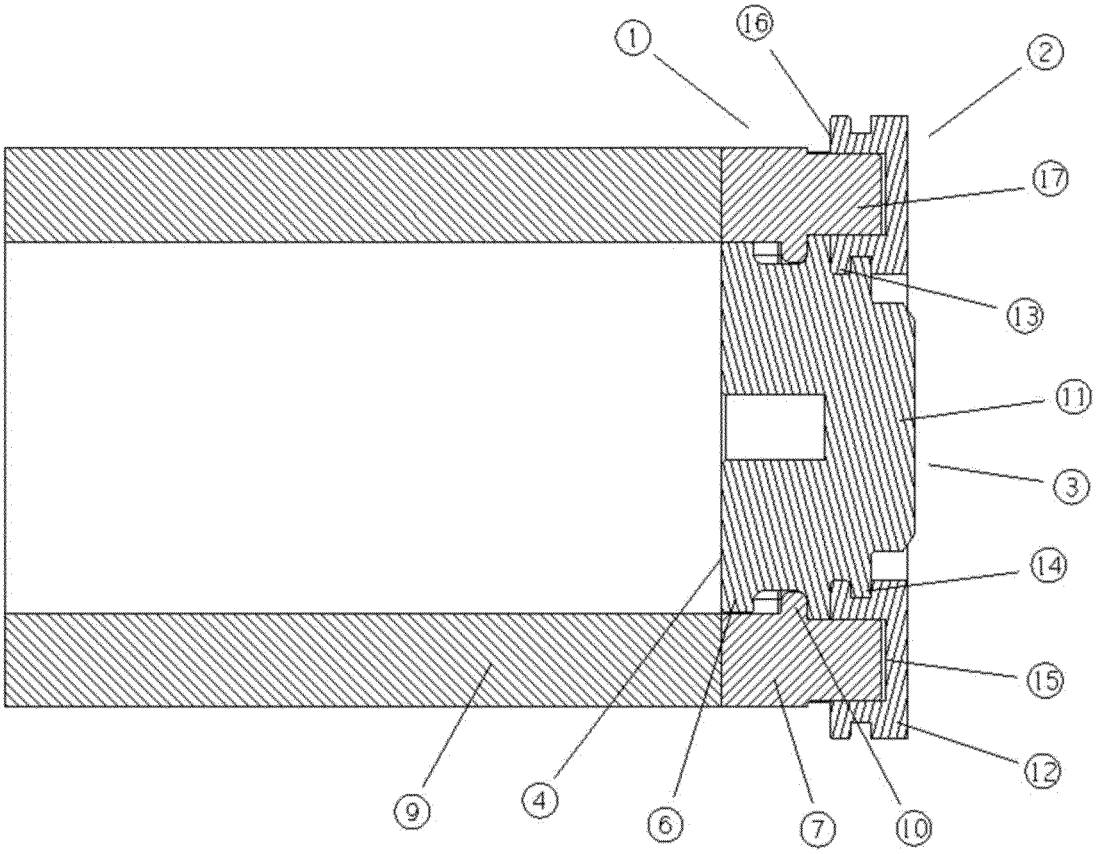
FIG. 18 is a longitudinal cross-section of a drill bit assembly according to an eighth embodiment of the invention, attached to a wear sleeve of a percussion drill tool.

As shown in FIGS. 18 and 20, a recess 15 is provided in a rearwardly-directed face 16 of each of the plurality of bit inserts 12. The drive ring 7 is provided with a corresponding plurality of protrusions 17 at a forward end thereof. In this embodiment, the protrusions 17 are substantially cylindrical in shape and the recesses 15 are correspondingly shaped. Each drive dog segment 18 comprises one of the plurality of protrusions. When the assembly is assembled, each protrusion 17 is received within a corresponding recess 15 to transmit rotational drive from the drive ring to the percussion bit.

To assemble the drill bit assembly of the eighth embodiment, the drill bit 1 is positioned relative to the wear sleeve 9 in the drop-out position as shown in FIG. 21. A single drive dog segment 18 and a single bit insert 12 are assembled together by inserting protrusion 17 into recess 15 and slid into the main body of the head portion 3 of the bit, such that a lip 13 of the insert engages with a shoulder 14 of the main body 11 and shoulder portion 10 on the drive dog segment engages with retaining shoulder 6 on the bit. The drive dog segment 18 is then bolted to the wear sleeve 9 via holes 8 which can be accessed externally. In an alternate embodiment, large bolts may be are screwed in from the top of the wear sleeve down into the drive dogs to retain the drive dogs in the assembly.

Each pair of drive dog segment and bit insert is added in the same way. Once all of the drive dog segments have been added, the drive dog segments form a continuous annular drive ring 7. The drive ring is retained in the assembly by way of the bolts and the drive ring in turn retains the percussion bit 1 in the assembly. The inserts are engaged with the main body of the bit by way of lips 13 and shoulders 14. Rotational drive is transmitted from the drive ring 7 to the bit 1 by engagement of the protrusions 17 with the recesses 15 in the bit inserts. In this embodiment, the shape of the bit inserts and the protrusions is such that each of the inserts is rotatable relative to the bit head. During operation of the tool, the inserts will rotate due to the rotational torque of the tool. This increases the lifetime of the bit inserts by distributing wear over the whole of the cutting face of each insert as they rotate in the bit head.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A drill bit assembly for fluid-operated percussion drill tools, comprising:

a percussion bit having a head portion and a bit retaining portion;

engagement means on the head portion engageable with complementary engagement means on a drive ring whereby rotational drive from the drive ring is transmitted to the percussion bit;

bit retaining means adapted for engagement with the bit retaining portion of the percussion bit to retain the percussion bit in the drill bit assembly; and connection means on the drive ring adapted for connecting the drive ring to a drive means of the fluid-operated percussion drill tool, wherein the drive ring comprises a plurality of separable part-annular drive dog segments, wherein the bit retaining means are provided on at least two of the drive dog segments, and wherein each drive dog segment receives a bolt for individually connecting the drive dog segment to the drive means of the fluid-operated percussion drill tool.

2. The drill bit assembly as claimed in claim 1, wherein the complementary engagement means, for engagement with the engagement means on the head portion of the bit, are provided on at least two of the drive dog segments.

3. The drill bit assembly as claimed in claim 1, wherein the bit retaining portion of the percussion bit comprises a retaining shoulder.

4. The drill bit assembly as claimed in claim 1, wherein the bit retaining means comprises a shoulder formed internally of the drive ring for engagement with the bit retaining portion of the percussion bit to retain the bit in the assembly.

5. The drill bit assembly as claimed in claim 4, wherein the shoulder is integrally formed with the drive ring.

6. The drill bit assembly as claimed in claim 1, wherein the engagement means on the head portion comprises a plurality of recesses, and wherein the complementary engagement means on the drive ring comprises a corresponding plurality of protrusions at a forward end thereof, whereby each protrusion is received within a corresponding recess to transmit rotational drive from the drive ring to the percussion bit.

7. The drill bit assembly as claimed in claim 6, wherein the bit retaining means comprises a shoulder formed on each of at least two of the protrusions on the drive ring and wherein the bit retaining portion of the percussion bit comprises a retaining shoulder formed at an opening of the corresponding recesses in the head portion of the bit.

8. The drill bit assembly as claimed in claim 7, wherein the shoulder is formed around three sides of each of the at least two protrusions and wherein the retaining shoulder is formed around three sides of the corresponding recesses.

9. The drill bit assembly as claimed in claim 1, wherein the head portion of the bit comprises a main body and a plurality of bit inserts engaged therewith, and wherein the engagement means is provided in the bit inserts.

10. The drill bit assembly as claimed in claim 9, wherein the bit inserts are provided in a radially spaced-apart arrangement at a forward end of the main body of the head portion of the percussion bit.

11. The drill bit assembly as claimed in claim 9, wherein the engagement means on the head portion comprises a recess provided in a rearwardly-directed face of at least two of the plurality of bit inserts, and wherein the complementary engagement means on the drive ring comprises a corresponding plurality of protrusions at a forward end thereof, whereby each protrusion is received within a corresponding recess to transmit rotational drive from the drive ring to the percussion bit.

12. The drill bit assembly as claimed in claim 11, wherein each drive dog segment comprises one of the plurality of protrusions.

13. The drill bit assembly as claimed in claim 9, wherein a recess is provided in a rearwardly-directed face of at least two of the plurality of bit inserts, wherein a corresponding plurality of protrusions is provided at a forward end of the drive ring, and wherein each of the bit inserts, recesses and protrusions is shaped such that the insert engaged with the main body of the head portion of the bit is rotatable relative to the main body of the head portion of the bit.

14. A drill bit assembly for fluid-operated percussion drill tools, comprising:

a percussion bit having a head portion and a bit retaining portion;

engagement means on the head portion engageable with complementary engagement means on a drive ring whereby rotational drive from the drive ring is transmitted to the percussion bit;

bit retaining means adapted for engagement with the bit retaining portion of the percussion bit to retain the percussion bit in the drill bit assembly; and connection means on the drive ring adapted for connecting the drive ring to a drive means of the fluid-operated percussion drill tool, wherein the head portion of the bit comprises a main body and a plurality of bit inserts engaged therewith, wherein the engagement means is provided by the bit inserts, and wherein each bit insert is slidably engaged with the main body of the bit and retained in the main body by way of a lip on the bit insert that engages with a complementary shoulder on the main body.

15. The drill bit assembly as claimed in claim 14, wherein the bit inserts are provided in a radially spaced-apart arrangement at a forward end of the main body of the head portion of the percussion bit.

16. The drill bit assembly as claimed in claim 14, wherein the engagement means on the head portion comprises a recess provided in a rearwardly-directed face of least two of the plurality of bit inserts, and wherein the complementary engagement means on the drive ring comprises a corresponding plurality of protrusions at a forward end thereof, whereby each protrusion is received within a corresponding recess to transmit rotational drive from the drive ring to the percussion bit.

17. The drill bit assembly as claimed in claim 14, wherein a recess is provided in a rearwardly-directed face of at least two of the plurality of bit inserts, wherein a corresponding plurality of protrusions is provided at a forward end of the drive ring, and wherein each of the bit inserts, recesses and protrusions is shaped such that the insert engaged with the main body of the head portion of the bit is rotatable relative to the main body of the head portion of the bit.

18. A drill bit assembly for fluid-operated percussion drill tools, comprising:

a percussion bit having a head portion and a bit retaining portion;

engagement means on the head portion engageable with complementary engagement means on a drive ring whereby rotational drive from the drive ring is transmitted to the percussion bit;

bit retaining means adapted for engagement with the bit retaining portion of the percussion bit to retain the percussion bit in the drill bit assembly; and an internal screw-thread provided at an upper part of the drive ring for connecting the drive ring to an external screw-thread provided at a lower end of an outer wear sleeve of the fluid-operated percussion drill tool, such that the bit retaining means is retained between the outer wear sleeve and a shoulder formed internally of the drive ring.

19. The drill bit assembly as claimed in claim 18, wherein the bit retaining means is retained between a lower end of the outer wear sleeve and the shoulder formed internally of the drive ring.

20. The drill bit assembly as claimed in claim 18, wherein the engagement means on the head portion comprises a plurality of recesses, and wherein the complementary engagement means on the drive ring comprises a corresponding plurality of protrusions at a forward end thereof, whereby each protrusion is received within a corresponding recess to transmit rotational drive from the drive ring to the percussion bit.

* * * * *